US005595961A

United States Patent [19]

Doner et al.

[11] Patent Number: 5,595,961

[45] Date of Patent: Jan. 21, 1997

[54] GREASE COMPOSITION

[75] Inventors: John P. Doner, Sewell; Andrew G. Horodysky, Cherry Hill; John A. Keller, Jr., Pitman, all of N.J.

[73] Assignee: Mobil Oil Corporation, Fairfax, Va.

[21] Appl. No.: 479,891

[22] Filed: Jun. 7, 1995

Related U.S. Application Data

[63] Continuation of Ser. No. 270,809, Jul. 5, 1994, abandoned, which is a continuation of Ser. No. 127,709, Sep. 28, 1993, abandoned, which is a continuation of Ser. No. 1,937, Jan. 8, 1993, abandoned, which is a continuation of Ser. No. 875,924, Apr. 29, 1992, abandoned, which is a continuation of Ser. No. 365,873, Jun. 14, 1989, abandoned, which is a continuation of Ser. No. 144,752, Jan. 19, 1988, abandoned, which is a continuation of Ser. No. 54,107, May 20, 1987, abandoned, which is a continuation of Ser. No. 892,877, Jul. 28, 1986, abandoned, which is a continuation of Ser. No. 641,078, Aug. 15, 1994, abandoned, which is a continuation-in-part of Ser. No. 577,454, Feb. 6, 1984, abandoned.

[51] Int. Cl.[6] ..... C10M 141/10; C10M 141/12

[52] U.S. Cl. ..... 508/186; 508/187

[58] Field of Search ..... 252/32.7 E, 42, 252/49.6

[56] References Cited

U.S. PATENT DOCUMENTS

| | | | |
|---|---|---|---|
| 3,158,574 | 11/1964 | Greenwood | 252/36 |
| 4,370,248 | 1/1983 | Horodysky et al. | 252/49.6 |
| 4,376,712 | 3/1983 | Horodysky et al. | 252/49.6 |

OTHER PUBLICATIONS

Smalheer et al., "Lubricant Additives", 1967 Chapter I.
Boner; "Lubricating Grease"; 1954 pp. 155, 436–437.
Hawley, The Condensed Chemical Dictionary, 1977.

*Primary Examiner*—Jacqueline V. Howard
*Attorney, Agent, or Firm*—Malcolm D. Keen

[57] ABSTRACT

Grease compositions, wherein the grease is thickened with a metal hydroxy-containing soap grease thickener are provided. Other essential ingredients of the compositions include borated hydroxyhydrocarbyl esters and phosphorus and/or sulfur compounds.

24 Claims, No Drawings

GREASE COMPOSITION

CROSS REFERENCE

This is a continuation of Ser. No. 08/270,809, filed Jul. 5, 1994 which is a continuation of Ser. No. 08/127,709, filed Sep. 28, 1993 which is a continuation of Ser. No. 08/001,937, filed Jan. 8, 1993 which is a continuation of Ser. No. 07/875,924, filed Apr. 29, 1992 which is a continuation of Ser. No. 07/365,873, filed Jun. 14, 1989 which is a continuation of Ser. No. 07/144,752, filed Jan. 19, 1988 which is a continuation of Ser. No. 07/054,107, filed May. 20, 1987 which is a continuation of Ser. No. 06/892,877, filed Jul. 28, 1986 which is a continuation of Ser. No. 06/641,078, filed Aug. 15, 1984 which is a continuation-in-part of Ser. No. 06/577,454 filed Feb. 6, 1984, all abandoned

BACKGROUND OF THE INVENTION

1. Field of the Invention

The invention is concerned with a novel group of compositions. It more particularly relates to a grease composition comprising oil, hydroxy-containing soap thickener and borated hydroxy-containing esters and phosphorus and sulfur moities.

2. Discussion of the Prior Art

Alcohols are well known for their lubricity properties when formulated into lubricating oils and for their water scavenging characteristics when blended into fuels. The use of vicinal hydroxyl-containing alkyl carboxylates such as gylcerol monoolerate have also found widespread use as lubricity additives. U.S. Pat. No. 2,788,326 discloses some of the esters suitable for the present invention, e.g., gylcerol monooleate, as minor components of lubricating oil compositions. U.S. Pat. No. 3,235,498 discloses, among others, the same ester as just mentioned, as an additive to other oils. U.S. Pat. No. 2,443,578 teaches esters wherein the free hydroxyl is found in the acid portion, as for example, in tartaric acid.

The above patents, as are numerous others, are directed to the use of such esters as additives. Other patents, such as U.S. Pat. Nos. 2,798,083; 2,820,014; 3,115,519; 3,282,917 and 3,309,318 as well as an article by R. R. Barnes et al. entitled "Synthetic Ester Lubricants" in Lubrication Engineering, August, 1975, pp 454–457, teach lubricants prepared from polyhydric alcohols and acids containing no hydroxyl other than those associated with the acid function.

So far as is known, no effort has been made to employ the borated mixtures of this invention as lubricant additives in conjunction with metal hydroxy-containing soap thickener and phosphorus and sulfur moieties. No prior art is known that teaches or suggests the unexpected results obtained by combining the known additives mentioned herein with the particular thickener and the borate hydroxyesters of this invention.

SUMMARY OF THE INVENTION

In accordance with the invention, there is provided an improved grease composition containing a major proportion of a grease and a minor amount of a compound prepared by reacting a hydrocarbyl ester of the formula:

$$R(COOR')_n$$

wherein R and $R^1$ are hydrocarbyl groups, or hydroxyhydrocarbyl groups, containing 1 to about 40 carbon atoms, preferably 8 to 20 carbon atoms, at least one of R or $R^1$ being a hydroxyhydrocarbyl group, m is 1 to about 5 and n is 1 to about 5, with a boron compound which may be a metaborate or similar boron source, boric acid, boric oxide or an alkyl borate of the formula:

$$(R^2O)_xB(OH)_y$$

wherein x is 1 to 3, y is 0 to 2, their sum being 3, and $R^2$ is an alkyl group containing from 1 to about 6 carbon atoms, the improvement comprising employing at least about 15% by weight of a hydroxy-containing soap thickener to prepare said grease. The presence of phosphorus and sulfur moieties provides an even higher dropping point. Hydrocarbyl and hydroxyhydrocarbyl include alkyl, aryl, aralkyl, alkaryl and cycloalkyl groups.

Preferably the ester is overborated. By "overborated" is meant the presence in the borated product of more than a stoichiometric amount of boron.

The esters may contain from 1 to 5 hydroxy groups in the molecule. They may all be attached to R or $R^1$ or they may be attached to R and $R^1$ in varying proportions. Further, the hydroxy groups can be at any position or positions along the chain of R or $R^1$. It will be understood that the esters contain at least one free hydroxy group prior to reaction with the boron compound.

The disclosed esters can be made by methods well known in the art. In general, they are made by reacting the desired acid or acyl halide and alcohol at temperatures and for times one skilled in the art can easily select. To give an ester having a free hydroxy group, either in R or $R^1$, reactant proportions are chosen accordingly, as one skilled in the art will understand. Suitable hydroxy-containing esters prior to boration include trimethylolpropane monooleate, trimethylolpropane dioleate, trimethylolpropane monostearate, trimethylolpropane distearate, trimethylolpropane monopelargonate, trimethylolpropane monooleate monopelargonate, pentaerythritol monooleate, pentaerythritol dioleate, pentaerythritol trioleate, pentaerythritol monoisostearate, pentaerythritol monooleate monopelargonate, pentaerythritol monoisostearate, monopelargonate or monohexanoate, pentaerythritol tripelargonate, glycerol monooleate, glycerol dioleate, glycerol monostearate, glycerol monoricinoleate, glycerol monoisostearate, glycerol monopelargonate, glycerol monohexadecanoate, sorbitan monooleate, sorbitan dioleate, sorbitan monostearate, sorbitan distearate, sorbitan monopelargonate, dipentaerythritol monooleate, dipentaerythritol monooleate, dipentaerythritol dioleate, dipentaerythritol trioleate, ethyleneglycol monooleate, ethyleneglycol monostearate, ethyleneglycol monoisostearate, diethyleneglycol monooleate, diethyleneglycol monopelargonate, diethyleneglycol monoisostearate and triethyleneglycol monoleate, methyl hydroxystearate and ethyl hydroxystearate, or mixtures of any of the above hydroxy-containing esters.

The third component of the grease compositions of this invention are sulfur and phosphorous moieties.

DESCRIPTION OF SPECIFIC EMBODIMENTS

The borated esters of the invention can be made by reacting an ester as defined above with a boron compound, such as boric oxide, a metaborate, boric acid, an alkyl borate or mixtures thereof. The resulting products are primarily borate esters, but other possible products present are the products of reaction between ester dimers, or higher oligomers, and a boron compound to form the corresponding borate esters, As noted hereinabove, the boron compound used may be boric acid, boric oxide or an alkyl borate, preferably boric acid. The alkyl borates include the mono-, di- and trialkyl borates, such as the mono-, di- and trimethyl borates, mono-, di- and triethyl borates, mono-, di- and tripropyl borates, mono-, di- and tributyl borates, mono-, di- and tripentyl borates and mono-, di- and trihexyl borates, The reaction to form the borate ester can be carried out at from about 80° C. to about 260° C., preferably from about 110° C. to about 180° C. The temperature chosen will depend for the most part on the particular reactants and on whether or not a solvent is used. Reaction pressures can be vacuum, atmospheric, or positive pressure. In carrying out this reaction, it is preferable that quantities of reactants be chosen such that the molar ratio of ester to boron compound be from about 1 to about 4, preferably from about 1 to about 2, or more preferably, of from about 1 to about 1. The ester may be reacted with an excess of the borating species to form a borate ester containing from about 0.1% by weight of boron to as much as 10% or more of boron, While atmospheric pressure is generally preferred, the reaction can be advantageously run at from about 1 to about 5 atmospheres. Furthermore, where conditions warrant it, a solvent may be used. In general, any relatively non-polar, unreactive solvent can be used, including benzene, toluene, xylene and 1,4-dioxane. Other hydrocarbon and alcoholic solvents, which include propanol, butanol, hexamethyleneglycol and the like, can be used. Mixtures of alcoholic and hydrocarbon solvents can be used also.

The times for the reactions are not critical. Thus, any phase of the process can be carried out in from about 1 to about 20 hours.

A narrow class of thickening agents is used to make the grease of this invention. The thickening agents contain at least a portion of alkali metal, alkaline earth metal or amine soaps of hydroxyl-containing fatty acids, fatty glycerides and fatty esters having from 12 to about 30 carbon atoms per molecule. The metals are typified by sodium, lithium, calcium and barium. Preferred is lithium. Preferred members among these acids and fatty materials are 12-hydroxystearic acid and glycerides containing 12-hydroxystearates, 14-hydroxystearic acid, 16-hydroxystearic acid and 6-hydroxystearic acid.

The entire amount of thickener need not be derived from the aforementioned members. Significant benefit can be attained using as little thereof as about 15% by weight of the total thickener. A complementary amount, i.e., up to about 85% by weight of a wide variety of thickening agents can be used in the grease of this invention. Included among the other useful thickening agents are alkali and alkaline earth metal soaps of methyl-12-hydroxystearate, diesters of a $C_4$ to $C_{12}$ dicarboxylic acid and tall oil fatty acids. Other alkali or alkaline earth metal fatty acids containing from 12 to 30 carbon atoms and no free hydroxyl may be used. These include soaps of stearic and oleic acids.

Manufacture of the thickening agents can be done in a variety of grease-making equipment such as open kettles at reduced, atmospheric, or positive pressures; higher pressure reaction chambers which may be operated to as high as 180 psig; or continuous manufacturing equipment. The temperature range from the bulk grease under manufacture may range from 15° C. (60° F.) to 287° C. (550° F.).

Other thickening agents include salt and salt-soap complexes as calcium stearate-acetate (U.S. Pat. No. 2,197,263), barium stearate acetate (U.S. Pat. No. 2,564,561), calcium, stearate-caprylate-acetate complexes (U.S. Pat. No. 2,999,065), calcium caprylate-acetate (U.S. Pat. No. 2,999,066), and calcium salts and soaps of low-, intermediate- and high-molecular weight acids and of nut oil acids.

Another group of thickening agents comprises substituted ureas, phthalocyamines, indanthrene, pigments such as perylimides, pyromelliticdiimides, and ammeline, as well as certain hydrophobic clays. These thickening agents can be prepared from clays which are initially hydrophilic in character, but which have been converted into a hydrophobic condition by the introduction of long-chain hydrocarbon radicals into the surface of the clay particles prior to their use as a component of a grease composition, as, for example, by being subjected to a preliminary treatment with an organic cationic surface active agent, such as an onium compound. Typical onium compounds are tetraalkylammonium chlorides, such as dimethyl dioctadecyl ammonium chloride, dimethyl dibenzyl ammonium chloride and mixtures thereof. This method of conversion, being well known to those skilled in the art, is believed to require no further discussion, and does not form a part of the present invention.

The third member(s) that is present in the grease composition are the phosphorus and sulfur moieties. Both of these can be present in the same molecule, such as in a metal or non-metal phosphorodithioate of the formula

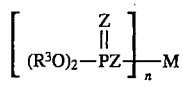

wherein $R^3$ is a hydrocarbyl group containing about 3 to about 18 carbon atoms, M is preferably a metal, but may be a non-metal, such as one of those mentioned hereinbelow, n is the valence of M and Z is oxygen or sulfur, at least one Z being sulfur.

In this compound, $R^3$ is preferably an alkyl group and may be a propyl, butyl, pentyl, hexyl, octyl, decyl, dodecyl, tetradecyl or octadecyl group, including those derived from isopropanol, propanol, butanol, isobutanol, sec-butanol, 4-methyl-2-pentanol, 2-ethylhexanol, oleyl alcohol, and mixtures thereof. Further included are alkaryl groups such as butylphenyl, octylphenyl, nonylphenyl and dodecylphenyl groups.

The metals embraced by M include those in Groups IA, IIA, IIB and VIII of the Periodic Table. Some that may be mentioned are lithium, sodium, calcium, zinc, cadmium, silver, gold and molybdenum. Non-metallic ions include organic groups derived from vinyl esters such as vinyl acetate, vinyl ethers such as butyl vinyl ether and epoxides such as propylene oxide and 1,2-epoxydodecane. The non-metallic ions may also be derived from nitrogenous compounds such as those derived from hydrocarbyl amines and diamines, including oleylamine and N-oleyl-1,3-propylenediamine and such as the imidazolines and oxazolines.

The phosphorus and sulfur can also be supplied from the combination of two separate compounds, such as the combination of (1) a dihydrocarbyl phosphite having about 2 to about 10 carbon atoms in each hydrocarbyl group or mixtures of phosphites and (2) a sulfide such as sulfurized isobutylene, dibenzyl disulfide, sulfurized terpenes, phosphorodithionyl disulfide and sulfurized vegetable oils. The phosphites include the dibutyl, dihexyl, dioctyl, didecyl and similar phosphites. Phosphate esters containing about 4 to about 20 carbon atoms in each hydrocarbyl group, such as tributyl phosphate, tridecyl phosphate, tricresyl phosphate and mixtures of such phosphates, can also be used.

In summary, it is essential to the practice of this invention, in which greases having unobviously improved dropping points are obtained, that the three above-mentioned ingredients be formulated into the composition. Thus:

first, with respect to the preparation of the grease, the thickener will have at least about 15% by weight of a metal or non-metal hydroxyl-containing soap therein, the total thickener being from about 3% to about 20% by weight of the grease composition;

second, there will be added to the grease from about 0.01% to about 10% by weight, preferably about 0.1% to about 2%, of a borated ester, in which such ester has been reacted with preferably at least an equimolar amount of boron compound; and as a third component, the composition will have therein from 0.01% to about 10% by weight, preferably from 0.2% to 2% by weight, of phosphorus- and sulfur-containing compounds or a mixture of two or more compounds which separately supply the phosphorus and sulfur moieties. If separate compounds are used, an amount of the mixture equivalent to the above concentration levels is used to supply desired amounts of phosphorus and sulfur.

It was noted that, when the hydroxy-containing thickener was used with the borated ester, the dropping point of the grease was consistently unexpectedly higher than with a grease from the same grease vehicle and the same borated ester, but with a different thickener, e.g., a non-hydroxy-containing thickener. The broad invention is, however, to a grease composition comprising the three components mentioned.

In general, the reaction products of the present invention may be employed in any amount which is effective for imparting the desired degree of friction reduction, antiwear activity, antioxidant activity, high temperature stability or antirust activity. In many applications, however, the borated esters and the phosphorus- and/or sulfur-containing compound(s) are effectively employed in combined amounts from about 0.02% to about 20% by weight, and preferably from about 0.2% to about 4% of the total weight of the composition.

The greases of the present invention can be made from mineral oils, vegetable oils or synthetic oils, or mixtures thereof. In general, mineral oils, both paraffinic, naphthenic and mixtures thereof, may be of any suitable lubricating viscosity range, as for example, from about 45 SSU at 100° F. to about 6000 SSU at 100° F., and preferably from about 50 to about 250 SSU at 210° F. These oils may have viscosity indexes ranging to about 100 or higher. Viscosity indexes from about 70 to about 95 are preferred. The average molecular weights of these oils may range from about 250 to about 800. In making the grease, the lubricating oil from which it is prepared is generally employed in an amount sufficient to balance the total grease composition, after accounting for the desired quantity of the thickening agent, and other additive components to be included in the grease formulation.

In instances where synthetic oils are desired, in preference to mineral oils, various compounds of this type may be successfully utilized. Typical synthetic vehicles include polyisobutylene, polybutenes, hydrogenated polydecenes, polypropylene glycol, polyethylene glycol, trimethylol propane esters, neopentyl and pentaerytbritol esters, di(2-ethylhexyl) sebacate, di(2-ethylhexyl) adipate, dibutyl phthalate, fluorocarbons, silicate esters, silanes, esters of phosphorus-containing acids, liquid ureas, ferrocene derivatives, hydrogenated synthetic oils, chain-type polyphenyls, siloxanes and silicones (polysiloxanes), alkyl-substituted diphenyl ethers typified by a butyl-substituted bis(p-phenoxy phenyl) ether, phenoxy phenylethers.

The metallic soap grease compositions containing one or more of the borated hydroxy-containing ester and one or more of the sulfur and phosphorus combinations described herein provide advantages in increased dropping point, improved grease consistency properties, antirust characteristics and potential antifatigue, antiwear and antioxidant benefits unavailable in any of the prior greases known to us. The grease of this invention is unique in that it can be preferably manufactured by the admixture of additive quantities of the alcohol borates to the fully formed soap grease after completion of saponification.

The following Examples will present illustrations of the invention. They are illustrative only, and are not meant to limit the invention. Examples 6, 7 and 8 are provided for comparison purposes.

EXAMPLE 1

Glycerol monooleate (115 g), consisting of a mixture of about 60% of glycerol monooleate and about 40% of glycerol dioleate, xylene (38 g) and butanol (122 g) were charged to a reactor equipped with a heater, an agitator and a condenser. The reactor contents were heated to about 50° C., and boric acid (100 g) was charged to the reactor. The reaction mixture was heated to about 204° C. and was held there for about 3 hours until water evolution ceased. The reactor contents were cooled to about 155° C. and vacuum (to less than 2 mm of Hg) was applied to remove the solvents. The crude product was further cooled to about 105° C. and it was then filtered through diatomaceous earth to yield a viscous, amber liquid.

EXAMPLE 2

Same as Example 1, except that the following ratios by weight were used to give an excess of boron:

7.55 pounds glycerol monooleate/pound boric acid 1.13 pounds butanol/pound boric acid 0.17 pound xylene/pound boric acid

EXAMPLE 3

A lithium hydroxystearate grease thickener was prepared by saponification of a mixture containing 12-hydroxystearic acid (8%) and the glyceride thereof (9%) with lithium hydroxide in a mineral oil vehicle at about 177° C. in a closed contactor. After depressuring and dehydration of the thickener in an open kettle, sufficient mineral oil was added to reduce the thickener content to about 9.0%. After cooling to about 99° C., a typical grease additive package, consisting of an amine antioxidant, phenolic antioxident, metallic dithiophospate, sulfur-containing metal deactivator and nitrogen containing antirust additives, was added. This produced a base grease for evaluating the effect of borated hydroxyl-containing esters on grease dropping point and other properties.

EXAMPLE 4

To the grease of Example 3 was added 2 wt. % of the borated glycerol monooleate of Example 1. The addition was accomplished in a laboratory grease blender at from about 110° C. to about 116° C.

EXAMPLE 5

Same as Example 4, except that 2 wt. % of the borated glycerol monooleate of Example 2 was used.

EXAMPLE 6

Prepared like the grease of Example 3, except that the mineral oil was thickened with the lithium soap of a 50/50 (wt) mixture of stearic and palmitic acids.

EXAMPLES 7 & 8

Prepared as shown in Table 1. The dropping point results, obtained using the ASTM D-2265–78 Test, are summarized in Table I.

TABLE I

| | | D2265 Dropping Point, °C. |
|---|---|---|
| Base Grease A (Example 3) | Containing amine antioxidant, phenolic antioxidant, 1.5 wt. % of zinc dialkyl phosphorodithioate, (where alkyl is derived from a mixture of $C_3$ to $C_6$ primary alcohols), and sulfur-containing metal deactivator and nitrogen containing antirust additives. | 202 |
| Example 4 - | Base grease A + 2.0 wt. % borated glycerol monooleate | 240 |
| Example 5 - | Base grease A + 2.0 wt. % borated glycerol monooleate (⅓ excess boron) | 290 |
| Base Grease B (Example 6) | Base grease thickened with lithium and with lithium soap of a 50/50 (wt) mixture of stearic and palmitic acids | 209 |
| Example 7 - | 50 wt. % of base grease A used in Examples 4 and 5 and 50 wt. % of base grease B of Example 6 | 190 |
| Example 8 - | Base grease of Example 6 containing 2 wt. % of the borated glycerol monooleate of Example 1 | 207 |

Example 8 clearly shows no dropping point improvement when the borated ester is added to a non-hydroxy-containing carboxylate soap thickened grease.

The following example further demonstrates the superiority of the grease of this invention over that of the prior art.

EXAMPLE 9

Samples of greases were prepared as follows:

A first batch of grease was prepared thickened with lithium hydroxide and a non-hydroxy-substituted stearic acid, The amount of mineral oil vehicle which was included was more than 90% and the ratio of lithium hydroxide to non-hydroxy stearic acid was slightly greater than equimolar. A portion of this material was designated as Sample A and set aside for testing. The remaining portion of this first batch was further mixed with 1.25% by weight of borated glycerol monooleate (containing about 55% glycerol monooleate and about 45% glycerol dioleate), A portion of this was designated Sample B and set aside for testing. The rest of the batch was combined with 1.5% of zinc dialkyldithiophosphate and designated as Sample C.

Another set of samples was prepared in which the grease was thickened with 12-hydroxy-stearic acid and lithium hydroxide as in the first batch described just above. The amount of mineral oil vehicle was greater than 90%. The ratio of lithium hydroxide to 12-hydroxy stearic acid was slightly greater than equimolar, A portion of this batch was set aside and designated as Sample D. The remainder of this second batch was mixed with 1.25% by weight of borated glycerol monooleate and a portion thereof set aside and designated as Sample E. The remainder of this second batch was combined with 1.5% of zinc dialkyldithiophlosphate and designated as Sample F. Each of the samples prepared as just described were tested for dropping point. Results are tabulated below in Table II.

TABLE II

| Sample Number | Composition | Dropping Point Degrees F. | Dropping Point Degrees C. |
|---|---|---|---|
| A | Grease, with lithium stearate thickener, additive free | 348 | 176 |
| B | Same grease as "A" above, but also containing 1.25% by weight added borated glycerol moneoleate | 351 | 177 |
| C | Same grease as "B" above, but also containing 1.5% by weight zinc dialkyldithiophosphate | 355 | 179 |
| D | Lithium 12-hydroxy stearate grease, additive free | 382 | 194 |
| E | Same grease as "D" above plus 1.25% by weight of borated glycerol monooleate | 476 | 247 |
| F | Same grease as "E" above plus 1.5% by weight of zinc dialkyldithiophosphate | 640 | 338 |

Samples A, B and C use a lithium stearate (non-hydroxy) carboxylate as a thickener. As would be expected no dropping point elevation was noted for Samples B and C. Sample E showed an elevation of 94° F. in dropping point when a borated glycerol hydroxystearate was used to thicken the grease. An additional increase of 146° F. in Sample F was observed when phosphorous and sulfur compounds were added. This extra elevation of dropping point by the addition of phosphorous and sulfur compounds does not occur when such compounds are added to a grease composition absent the borated glycerol monooleate ester. This point is demonstrated by Sample C.

Although the present invention has been described with preferred embodiments, it is to be understood that modifications and variations may be utilized without departing from the spirit and scope of this invention, as those skilled in the art will readily understand. Such modifications and variations are considered to be within the purview and scope of the appended claims.

We claim:

1. An improved grease composition comprising a) a major proportion of a grease including a thickener;

b) from about 0.01% to about 10% by weight of an additive capable of elevating the dropping pint of a grease containing a hydroxy-bearing thickener and made by reacting an ester of the formula $$R(COOR^1)_n$$

wherein n is 1 to about 5 and R and $R^1$ are hydrocarbyl or hydroxyhydrocarbyl groups containing 1 to about 40 carbon atoms, at least one of R and $R^1$ being a hydroxyhydrocarbyl group, with a boron compound selected from the group consisting of a metaborate, a boric acid, a boric oxide and an alkyl borate of the formula $$(R^1O)_xB(OH)_y$$

wherein x is 1 to 3 and y is 0 to 2, their sum being 3, and $R^2$ is an alkyl group having 1 to about 6 carbon atoms;

c) from about 0.01% by weight of a phosphorus and sulfur compound or a mixture of phosphorus-containing and sulfur-containing compounds to supply an equivalent amount of phosphorus and sulfur; and d) the thickener for said grease containing at least about 15% by weight of a hydroxy-containing soap thickener where the compounds in step c) provide for a grease composition having a substantially improved dropping point over a grease composition lacking said compounds.

2. The composition of claim 1 wherein the thickener is an alkali metal, alkaline earth metal or amine soap of a hydroxy-containing fatty acid, hydroxy-containing fatty glyceride or hydroxy-containing fatty ester containing 12 to about 30 carbon atoms.

3. The composition of claim 2 wherein the metal is sodium, lithium, calcium or barium.

4. The composition of claim 1 wherein the hydroxy-containing thickener is derived from 12-hydroxystearic acid, 14-hydroxystearic acid, 16-hydroxystearic acid, 6-hydroxystearic acid or the glyceride or ester thereof.

5. The composition of claim 1 wherein R is an alkyl, aryl, aralkyl, alkaryl or cycloalkyl group or a hydroxy-substituted member thereof.

6. The composition of claim 1 wherein the ester is trimethylolpropane monooleate, trimethylolpropane dioleate, trimethylolpropane monostearate, trimethylolpropane distearate, trimethylolpropane monopelargonate, trimethylolpropane monooleate monopelargonate, pentaerythritol monooleate, pentaerythritol dioleate, pentaerythritol trioleate, pentaerythritol monoisostearate, pentaerythritol monooleate monopelargonate, pentaerythritol monoisostearate, monopelargonate or monohexanoate, pentaerythritol tripelargonate, glycerol monooleate, glycerol dioleate, glycerol monostearate, glycerol monoricinoleate, glycerol monoisostearate, glycerol monopelargonate, glycerol monohexadecanoate, sorbitan monooleate, sorbitan dioleate, sorbitan monostearate, sorbitan distearate, sorbitan monopelargonate, dipentaerythritol monooleate, dipentaerythritol monooleate, dipentaerythritol dioleate, dipentaerytbritol trioleate, ethyleneglycol monooleate, ethyleneglycol monostearate, ethyleneglycol monoisostearate, diethyleneglycol monooleate, diethyleneglycol monopelargonate, diethylenegiycol monoisostearate and triethyleneglycol moonleate, methyl hydroxystearate or ethyl hydroxystearate and/or mixtures thereof.

7. The composition of claim 1 wherein the ester is glycerol monooleate, glycerol dioleate and/or mixtures thereof.

8. The composition of claim 1 wherein the boron compound is selected from a metaborate, a boric acid, a boric oxide and an alkyl borate of the formula:

$$(R^2O)_xB(OH)_y$$

wherein x is 1 to 3 and y is 0 to 2, their sum being 3, and $R^2$ is an alkyl group having 1 to about 6 carbon atoms.

9. The composition of claim 8 wherein the boron compound is selected from the group consisting of a metaborate, a boric acid, a boric oxide, mono-, di- and trimethyl borate, mono-, di- and triethyl borate, mono-, di- and tripropyl borate, mono-, di- and tributyl borate, mono-, di- and tripentyl borate and mono-, di- and trihexyl borate.

10. The composition of claim 9 wherein the boron compound is boric acid.

11. The composition of claim 1 wherein the phosphorus and sulfur compound is a phosphorodithioate of the formula $$\left[(R^3O)_2-\overset{\overset{Z}{\|}}{P}Z\right]_n-M$$

wherein $R^3$ is a hydrocarbyl group containing 3 to 18 carbon atoms, M is a metal or non-metal, n is the valence of H and Z is oxygen or sulfur, at least one of which is sulfur.

12. The composition of claim 11 wherein $R^3$ is an alkyl or alkaryl group.

13. The composition of claim 11 wherein $R^3$ is a propyl, butyl, pentyl, hexyl, octyl, dodecyl, tetradecyl, octadecyl, butylphenyl, octylphenyl, nonylphenyl, dodecylphenyl or oleyl group or mixtures thereof.

14. The composition of claim 11 wherein $R^3$ is derived from isopropanol, butanol, isobutanol, sec-butanol, 4-methyl-2-pentanol, 2-ethylhexanol or mixtures thereof.

15. The composition of claim 11 wherein M is a metal from Group IA, IIA, IIB or VIII of the Periodic Table.

16. The composition of claim 15 wherein M is, zinc.

17. The composition of claim 1 wherein the phosphorus and sulfur moieties are supplied by a combination of (1) a dihydrocarbyl phosphite having 2 to about 6 carbon atoms in each hydrocarbyl group, mixtures of such phosphites, or a phosphate ester having 4 to 20 carbon atoms in each hydrocarbyl group and (2) a sulfide selected from sulfurized isobutylene, dibenzyl disulfide, sulfurized terpenes, phosphorodithionyl disulfide and sulfurized vegetable oils.

18. The composition of claim 17 wherein the phosphite is a dibutyl, dihexyl, dioctyl or didecyl phosphite or mixtures thereof.

19. The composition of claim 17 wherein the phosphate ester is a tributyl, tridecyl or tricresyl phosphate or mixtures thereof.

20. The composition of claim 1 wherein the ester is glycerol monooleate, the boron compound is boric acid, the thickener is lithium 12-hydroxystearate and the phosphorus and sulfur moieties are from zinc dialkyl phosphorodithioate, where alkyl is a mixture of alkyls containing 3 to 6 carbon atoms.

21. The composition of claim 1 wherein the grease vehicle is a mineral oil.

22. The composition of claim 1 wherein the grease vehicle is a synthetic oil.

23. A method of improving the dropping point of a grease composition comprising incorporating into the grease composition including thickener;

(a) from about 0.01% to about 10% by weight of the product resulting from reacting an ester of the formula:

$$R(COOR^1)_n$$

wherein n is 1 to about 5 and R and $R^1$ are hydrocarbyl or hydroxyhydrocarbyl groups containing 1 to about 40 carbon atoms, at least one of R and $R^1$ being a hydroxyhydrocarbyl group, with a boron compound selected from the group consisting of a metaborate, a boric acid, a boric oxide and an alkyl borate of the formula $$(R^2O)_xB(OH)_y$$

wherein x is 2 to 3 and y is 0 to 2, the sum of x and y being 3, and $R^2$ is an alkyl group containing 1 to about 6 carbon atoms;

b) from about 0.0.1% by weight of a phosphorus and sulfur compound or a mixture of phosphorus-containing and sulfur-containing compounds to supply an equivalent amount of phosphorus and sulfur; and (c) the thickener containing at least about 15% by weight of a hydroxy-containing soap thickener where the compounds in step c) provide for a grease composition having a substantially improved dropping point over a grease composition lacking said compounds.

24. The method of claim 23 wherein the boron compound is selected from the group consisting of a metaborate, a boric acid, a boric oxide or an alkyl borate of the formula:

$$(R^2O)_xB(OH)_y$$

wherein x is 2 to 3, y is 0 to 2, the sum of x and y being 3 and $R^2$ is an alkyl group containing from 1 to about 6 carbon atoms.

* * * * *